US009167332B2

(12) United States Patent
Chen

(10) Patent No.: US 9,167,332 B2
(45) Date of Patent: Oct. 20, 2015

(54) ELECTRONIC DEVICE AND METHOD FOR MEASURING ELECTRIC CURRENT OF EXTERNAL ELECTRONIC DEVICES USING THE ELECTRONIC DEVICE

(71) Applicant: HON HAI PRECISION INDUSTRY CO., LTD., New Taipei (TW)

(72) Inventor: Chin-Yi Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 303 days.

(21) Appl. No.: 13/873,213

(22) Filed: Apr. 29, 2013

(65) Prior Publication Data

US 2014/0153736 A1 Jun. 5, 2014

(30) Foreign Application Priority Data

Nov. 30, 2012 (TW) ..... 101144883 A

(51) Int. Cl.
*H04R 1/10* (2006.01)
*H04R 29/00* (2006.01)

(52) U.S. Cl.
CPC ..... *H04R 1/1041* (2013.01); *H04R 29/001* (2013.01); *H04R 2420/05* (2013.01)

(58) Field of Classification Search
CPC ..... H04R 5/033; H04R 1/1041
USPC ..... 381/74
See application file for complete search history.

(56) References Cited

U.S. PATENT DOCUMENTS

| | | | | |
|---|---|---|---|---|
| 2009/0296952 | A1* | 12/2009 | Pantfoerder et al. | 381/74 |
| 2010/0272252 | A1* | 10/2010 | Johnson et al. | 379/430 |
| 2014/0003616 | A1* | 1/2014 | Johnson et al. | 381/74 |
| 2014/0205109 | A1* | 7/2014 | Theiler | 381/74 |
| 2014/0292308 | A1* | 10/2014 | Gether | 324/133 |

* cited by examiner

*Primary Examiner* — Simon King
(74) *Attorney, Agent, or Firm* — Novak Druce Connolly Bove + Quigg LLP

(57) ABSTRACT

A portable electronic device and method for measuring electric current of an external electronic device by the portable electronic device are provided. The method includes detecting whether an external device is connected, through the earphone jack, or whether a simple headset is connected through the earphone jack. The earphone jack can pass audio signals from the headset, but if an external device is detected, software is implemented to measure the amplitude of electric current from the external electronic device.

11 Claims, 2 Drawing Sheets

ELECTRONIC DEVICE AND METHOD FOR MEASURING ELECTRIC CURRENT OF EXTERNAL ELECTRONIC DEVICES USING THE ELECTRONIC DEVICE

BACKGROUND

1. Technical Field

The present disclosure relates to portable electronic devices, and particularly to a portable electronic device and a method for measuring electric current of external electronic devices using the portable electronic device.

2. Description of Related Art

Electric current measuring equipment is specialized and bulky, and the portability is often a problem.

Therefore, it is desirable to provide a portable electronic device and a method for measuring electric current of external electronic devices using the portable electronic device, which can overcome the above-mentioned problem.

DETAILED DESCRIPTION

Embodiments of the disclosure will be described with reference to the accompanying drawings.

Figure 1:
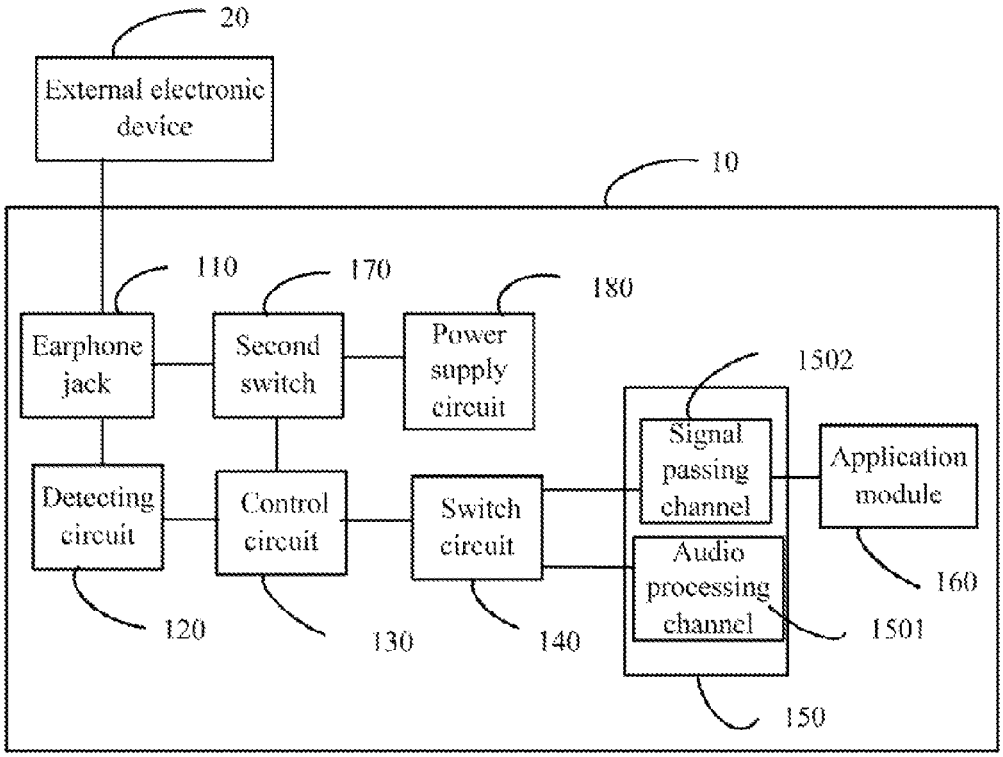
FIG. 1 is a functional block diagram of a portable electronic device capable of measuring electric current of external electronic devices, according to a first embodiment.

Referring to FIG. 1, a portable electronic device 10, such as a mobile phone, a personal digital assistant (PDA), or a notebook computer, according to an embodiment, is capable of measuring electric current of external electronic devices 20. The portable electronic device 10 includes an earphone jack 110, a detecting circuit 120, a control circuit 130, a switch circuit 140, an audio processing circuit 150, and an application module 160.

The earphone jack 110 can be a common earphone jack employed in many types of portable electronic devices for inputting and outputting audio signals. In this embodiment, the earphone jack 110 is configured for connecting the external electronic device 20 to the portable electronic device 10 via a cable (not shown). The cable has an earphone plug (not shown) at one end to mate with the earphone jack 110 and probes for contacting the electric circuits of an external electronic device 20 at another end thereof (not shown). The earphone jack 110 also can be connected to a headset (not shown). For example, the headset may include a microphone for inputting sound signals, and an earphone for outputting audio signals.

The detecting circuit 120 is connected to the earphone jack 110 and configured to detect whether the earphone jack 110 is connected to the external electronic device 20 or to the headset. In detail, the detecting circuit 120 detects whether the earphone jack 110 is connected to the external electronic device 20 or to the headset based on an input voltage of the earphone jack 110. If the input voltage is, for example, about 1V, then the earphone jack 110 is connected with the headset. If the input voltage is, for example, about 1.5V, then it is determined that the external electronic device 20 is connected to the earphone jack 110.

The detecting circuit 120 is also configured to receive electric current signals from the external electronic device 20 or sound signals from or to the headset via of the earphone jack 110.

The control circuit 130 is connected to the detecting circuit 120 and can be a baseband chip. The control circuit 130 generates a first control signal when the detecting circuit 120 detects that the earphone jack 110 is connected to the headset, and generates a second control signal when the detecting circuit 120 detects that the earphone jack 110 is connected to the external electronic device 20.

The audio processing circuit 150 includes an audio processing channel 1501 and a signal passing channel 1502. The audio processing channel 1501 processes the sound signals from or to the headset via the earphone jack 110. The signal passing channel 1502 is directly passes the electric current signals from the external electronic device 20.

One end of the switch circuit 140 is connected to the control circuit 130, and another end of the switch circuit 140 is switchably connected to one of the audio processing channel 1501 and the signal passing channel 1502 under the control of the control circuit 130. In detail, the switch circuit 140 is a single-pole double-throw (SPDT) switch which includes a first contact and two second contacts (not shown). One end of the first contact is connected to the control circuit 130, another end of the first contact is selectively connected to either of the two second contacts. The first contact is connected to the control circuit 130, and the two second contacts are connected to the audio processing channel 1501 and the sound signal passing channel 1502. When the control circuit 130 generates the first control signal, the first contact is controlled to connect to one of the second contacts which is connected to the audio processing channel 1501, when the control circuit 130 generates the second control signal, the first contact is controlled to connect to one of the second contact which is connected to the signal passing channel 1502.

The application module 160 is connected to the signal passing channel 1502, and implements a function by means of software to measure the electric current signals from the external electronic device 20. For example, the application module 160 carries out frequency and time analysis on the electric current signals.

In another embodiments, the portable electronic device 10 further includes a second switch 170 connected to the earphone jack 110 and the control circuit 130, and a power supply circuit 180 connected to the second switch 170. The second switch 170 is controlled to connect the power supply circuit 180 to the earphone jack 110 when the control circuit 130 generates the second control signal.

Figure 2:
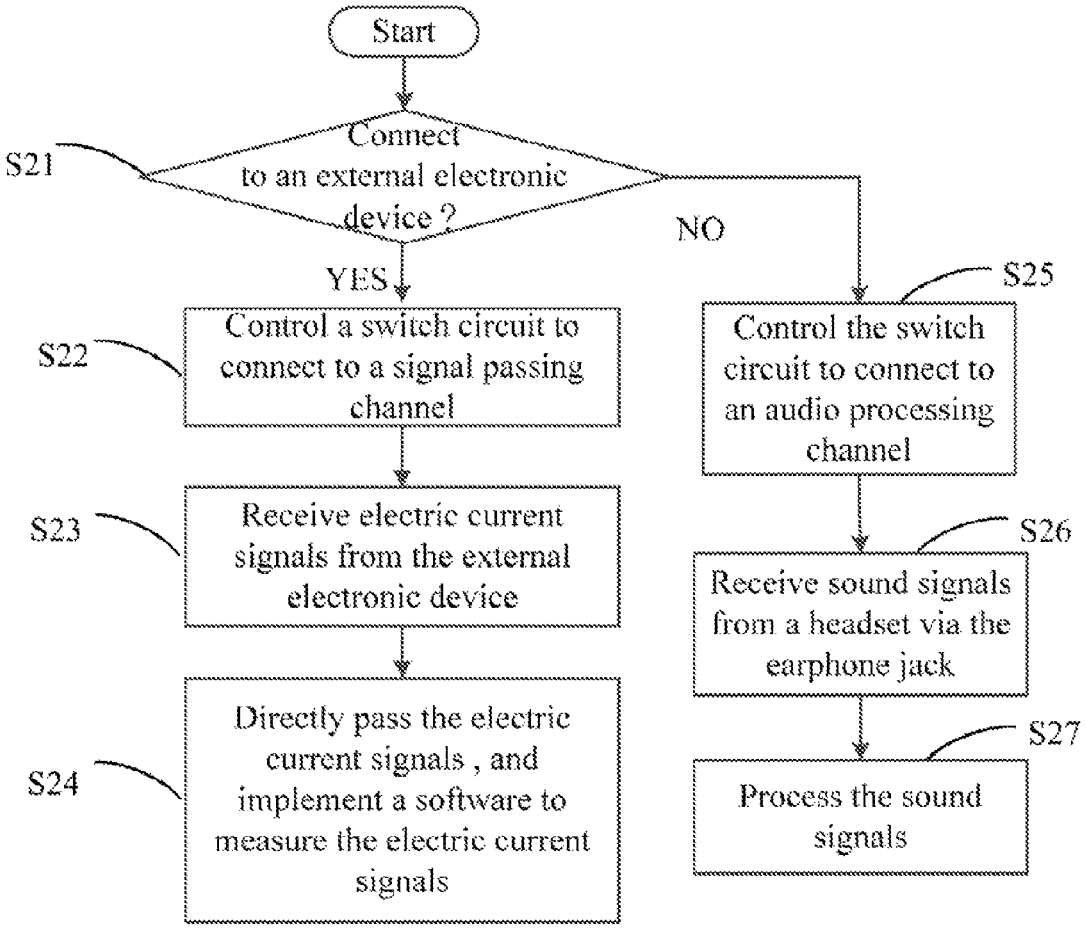
FIG. 2 is a flowchart showing a method for measuring electric current of external electronic devices using the portable electronic device of FIG. 1.

Referring to FIG. 2, a method for measuring electric current flowing through the external electronic device 20 using the portable electronic device 10 is implemented by steps S21 through S24.

In step S21, the detecting circuit 120 detects whether the earphone jack 110 is connected to the external electronic device 20 or to the headset based on the input voltage of the earphone jack 110. If the earphone jack 110 is connected to the external electronic device 20, the procedure goes to step S22, if the earphone jack 110 is connected to the headset, the procedure goes to step S25.

In step S22, the control circuit 130 generates the second control signal when the detecting circuit 120 detects that the earphone jack 110 is connected to the external electronic device 20, the first contact is connected to one of the second contacts which is connected to the signal passing channel 1502.

In step S23, the detecting circuit 120 receives electric current signals from the external electronic device 20.

In step S24, the signal passing channel 1502 directly passes the electric current signals from the external electronic device 20, and the application module 160 implements software to measure the electric current signals from the external electronic device 20.

In step S25, the control circuit 130 generates the first control signal when the detecting circuit 120 detects that the earphone jack 110 is connected to the headset, the first contact is connected to one of the second contacts which is connected to the audio processing channel 1501.

In step S26, the detecting circuit 120 receives sound signals from the headset via the earphone jack 110.

In step S27, the audio processing channel 1501 processes the sound signals from or to the headset via the earphone jack 110.

Particular embodiments are shown here and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A portable electronic device connected with an external electronic device, for measuring electric current of the external electronic device, the portable electronic device comprising:

an earphone jack;

a detecting circuit, connected to the earphone jack and configured to detect whether the earphone jack is connected to the external electronic device, and receive electric current signals from the external electronic device;

a control circuit, connected to the detecting circuit, for generating a first control signal when the detecting circuit detects that the earphone jack is connected to a headset, and generating a second control signal when the detecting circuit detects that the earphone jack is connected to the external electronic device;

an audio processing circuit comprising an audio processing channel and a signal passing channel, wherein the audio processing channel processes the sound signals from or to the headset via the earphone jack, and the signal passing channel directly passes the electric current signals from the external electronic device;

a switch circuit, with one end connected to the control circuit, another end switchably connected to one of the audio processing channel and the signal passing channel, for switching to the audio processing channel when the control circuit generates the first control signal, and switching to the signal passing channel a when the control circuit generates the second control signal; and an application module, connected to the signal passing channel, for implementing a software to measure the electric current signals from the external electronic device.

2. The portable electronic device according to claim 1, wherein the detecting circuit detects whether the earphone jack is connected to the external electronic device and receive electric current signals from the external electronic device based on an input voltage of the earphone jack.

3. The portable electronic device according to claim 1, wherein the switch circuit is a single-pole double-throw (SPDT) switch which comprises a first contact and two second contacts, one end of the first contact is connected to the control circuit, another end of the first contact is selectively connected to either of the two second contacts, and the two second contacts are connected to the audio processing channel and the sound signal passing channel.

4. The portable electronic device according to claim 3, further comprising a second switch connected to the earphone jack and the control circuit, and a power supply circuit connected to the second switch, wherein the second switch is controlled to connect the power supply circuit to the earphone jack when the control circuit generates the second control signal.

5. The portable electronic device 1 according to claim 1, wherein the control circuit is a baseband chip.

6. The portable electronic device according to claim 1, wherein the application module implements the software to measure the electric current signals from the external electronic device by displaying timing diagram and carrying out frequency and time analyzing according to the electric current signals.

7. A method for measuring electric current of an external electronic device by a portable electronic device, comprising:

detecting whether an earphone jack is connected to the external electronic device and receiving electric current signals from the external electronic device;

generating a first control signal when the detecting circuit detects that the earphone jack is connected to the earphone, and generating a second control signal when the detecting circuit detects that the earphone jack is connected to the external electronic device;

switching to the audio processing channel when the control circuit generates the first control signal, and switching to the signal passing channel when the control circuit generates the second control signal, wherein the audio processing channel processes the sound signals from or to the headset via the earphone jack, and the signal passing channel directly passes the electric current signals from the external electronic device; and implementing a software to measure the electric current signals from the external electronic device.

8. The method for measuring electric current of an external electronic device according to claim 7, wherein the method of detecting whether the earphone jack is connected to the external electronic device is based on an input voltage of the earphone jack.

9. The method for measuring electric current of an external electronic device according to claim 7, wherein the switch circuit is a single-pole double-throw (SPDT) switch which comprises a first contact and two second contacts, one end of the first contact is connected to the control circuit, another end of the first contact is selectively connected to either of the two second contact, and the two second contacts are connected to the audio processing channel and the sound signal passing channel.

10. The method for measuring electric current of an external electronic device according to claim 9, further comprising conducting a second switch to connect a power supply circuit to the earphone jack when the second control signal is generated to supply power to the external electronic device.

11. The method for measuring electric current of an external electronic device according to claim 7, wherein the method of implementing the software to measure the electric current signals from the external electronic device is by displaying timing diagram and carrying out frequency and time analyzing according to the electric current signals.

* * * * *